United States Patent [19]

Burysék et al.

[11] 4,369,620

[45] Jan. 25, 1983

[54] APPARATUS FOR SPINNING-IN YARNS IN OPEN-END ROTOR SPINNING UNITS

[75] Inventors: Frantisék Burysék, Usti nad Orlici; Karel Mikulécky, Chocen; Jiri Eliás, Brandys nad Orlici; Stanislav Eśner; Stanislav Skoda, both of Usti nad Orlici; Jan Janousék, Brandys nad Orlici, all of Czechoslovakia

[73] Assignee: Vyzkumny ustav bavlnarsky, Usit nad Orlici, Czechoslovakia

[21] Appl. No.: 233,398

[22] Filed: Feb. 11, 1981

[30] Foreign Application Priority Data

Feb. 13, 1980 [CS] Czechoslovakia ..... 1070-80

[51] Int. Cl.[3] ..... D01H 15/02

[52] U.S. Cl. ..... 57/263; 57/405

[58] Field of Search ..... 57/261–263, 57/58.89–58.95, 80, 81, 405

[56] References Cited

U.S. PATENT DOCUMENTS 3,354,631 11/1967 Elias et al. ..... 57/405 X 4,246,749 1/1981 Mikulecky et al. ..... 57/263

FOREIGN PATENT DOCUMENTS 161421 11/1975 Czechoslovakia .

*Primary Examiner*—John Petrakes

[57] ABSTRACT

The invention relates to an apparatus for the spinning-in of yarns in an open-end rotor spinning unit. The apparatus includes a spinning-in device for returning yarn end through a take-off duct into the spinning rotor, a severing device for shortening the yarn end to a predetermined length, and a withdrawing duct which communicates with the take-off duct and which is designed, on the one hand, for holding the yarn end by the action of a vacuum which, in the contact region of the two ducts, exceeds the working vacuum in the take-off duct, and, on the other hand, for withdrawing the severed yarn end. In accordance with an essential feature of the invention, at least one air nozzle opens into the withdrawing duct which during both spinning and spinning-in processes is connected to a subatmospheric pressure source, which nozzle is designed for introducing a fresh yarn end into the take-off duct by a controlled air outflow in a particular phase of the spinning-in process. The invention expediently utilizes the subatmospheric pressure air for both the spinning-in process and the withdrawal of impurities from the yarn in the take-off duct of the spinning rotor during the spinning process.

4 Claims, 6 Drawing Figures

Figure 1:
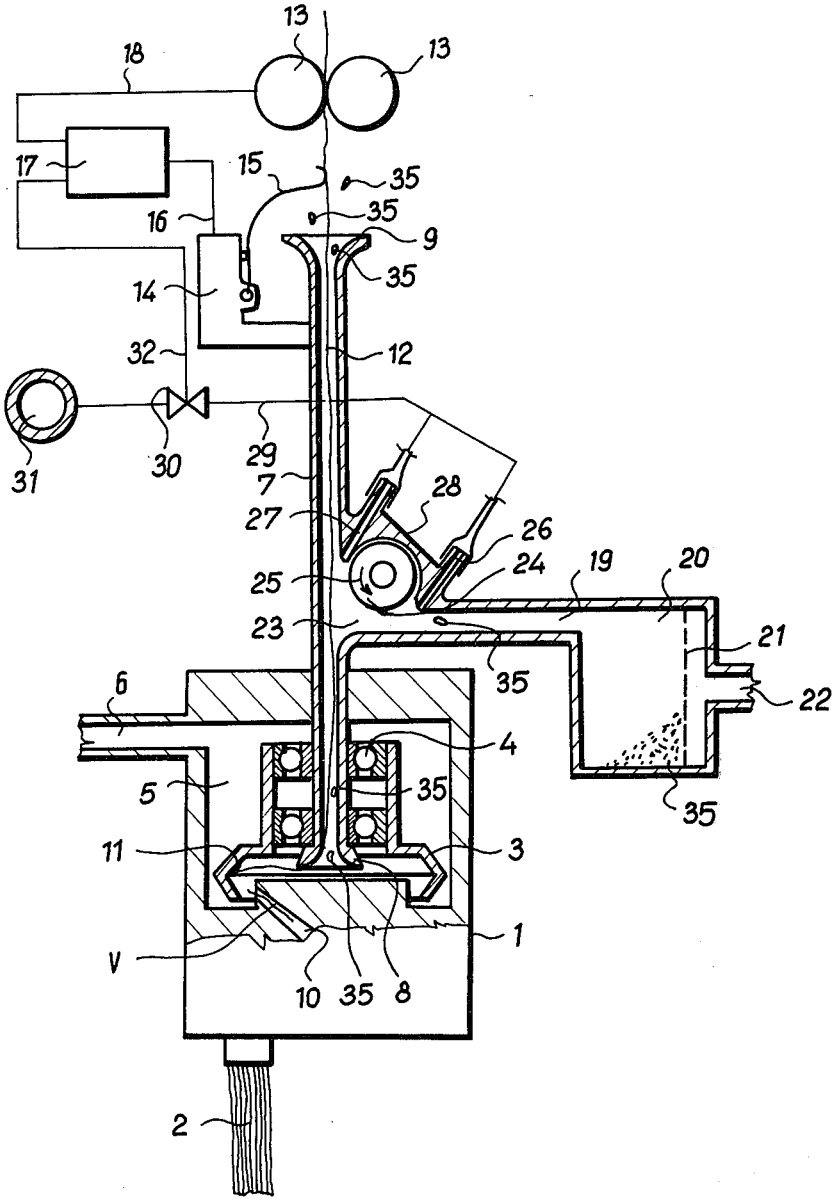

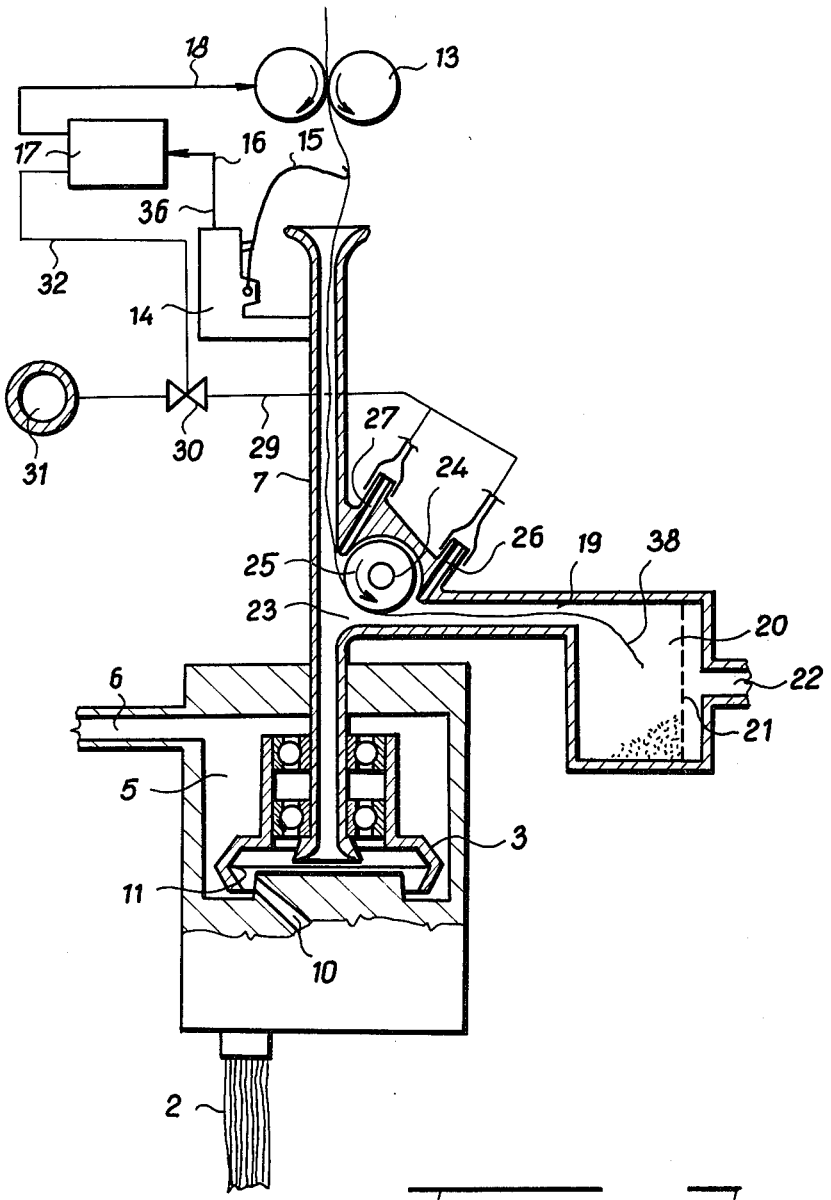
18
13
17
16
15
36
32
14
31
30
29
27
24
7
26
19
38
25
23
20
22
6
21
5
3
11
10
2
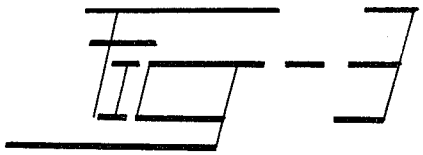

APPARATUS FOR SPINNING-IN YARNS IN OPEN-END ROTOR SPINNING UNITS

The invention relates to an apparatus for spinning-in yarns in an open-end rotor spinning unit comprising a spinning-in device for returning the yarn end through a take-off duct into the spinning rotor, a severing device for shortening the yarn end to a particular length, and a withdrawing duct which communicates with the take-off duct and which is designed, on the one hand, for holding the yarn end by the action of a vacuum which, in the contact region of the two ducts, exceeds the working vacuum in the take-off duct, and, on the other hand, for withdrawing the severed yarn end.

Apparatuses for spinning-in yarn in an open-end rotor spinning unit, wherein the yarn end is severed before being introduced into the spinning rotor, are known. In such apparatuses, the severed yarn end is withdrawn by subatmospheric pressure air produced by a separate vacuum source.

Thus, for example, according to German DE-OS No. 2,915,788, yarn is spun-in in the spinning unit by re-introducing its end which is present in the take-off duct into the spinning rotor by a vacuum effect. The yarn end, before being re-introduced into the spinning rotor, is severed in the region of the take-off duct by a severing device, and the severed yarn end is removed.

Between the take-off duct inlet and the severing device, the take-off duct communicates with a withdrawing duct for withdrawing the severed yarn end.

Yarn is returned to the spinning rotor within two time phases; in the first phase, it is stopped immediately after a breakage in the take-off duct, particularly in the vacuum effect region of the spinning rotor, whereupon it is transported into a withdrawing chamber of the withdrawing duct where the yarn end is held by suction. In the second phase, the yarn end is severed, the severed end is left in the withdrawing chamber, and another yarn return is initiated whereby the fresh yarn end is introduced into the spinning rotor.

In accordance with one variant of the aforementioned process, the yarn end is introduced, in the first spinning-in phase, into the withdrawing duct and is retained therein by an air flow issuing from a nozzle which opens into the withdrawing duct opposite the take-off duct. Immediately before the second phase of yarn return into the spinning rotor, the operation of said nozzle is interrupted, and the fresh yarn end is conveyed from said withdrawing duct into the take-off duct, due to the vacuum effect prevailing in the latter.

According to the second variant, the withdrawing duct is connected to a vacuum source within a controlled time interval only. In this case the nozzle is omitted. The subatmospheric pressure value necessary for introducing the yarn end from the take-off duct into the withdrawing duct has to exceed, in the contact region of the two ducts, the working vacuum prevailing in the take-off duct. The withdrawing duct is connected to subatmospheric pressure source in the first phase of the spinning-in process only.

It is an object of the present invention to widen the application scope of the subatmospheric pressure air source in open-end rotor spinning machines, which source has heretofore been used for a single purpose, viz. the spinning-in process. It has been found to be advantageous to use such a source for cleaning yarn in the take-off duct of the spinning rotor and consequently to raise the quality of the yarn produced and to reduce the clogging of the spinning rotor as well as to extend the rotor cleaning period.

A process of cleaning yarn in the take-off duct has, for instance, been disclosed in the Czechoslovak Inventor's Certificate No. 161,421. In the take-off duct, the yarn is exposed to a vacuum effect acting in the yarn take-off direction so that impurities separated in the take-off duct are withdrawn by said vacuum effect in the direction away from the spinning rotor. In an embodiment of the apparatus, the yarn take-off duct communicates via withdrawing duct to a vacuum source. The mouth of the withdrawing duct in the take-off is located in the region of motion of a control lever of the thread breakage feeler, which lever closes said mouth in case of a thread breakage and during the spinning-in process.

Such a solution of the problem, however, has many drawbacks. The essential shortcoming is in that a necessary packing of the control lever in the take-off duct raises the passive resistances to which the lever motion is exposed; such resistances reduce the sensitivity of the thread breakage feeler.

Such a reduction of feeler sensitivity, which is especially critical when spinning fine yarn counts, negatively influences the response of the feeler to a thread breakage so that there occurs an unwanted yarn end escape out of the take-off duct of the spinning rotor.

The construction of the take-off duct also negatively influences the spinning-in process. The packed spacings between the control feeler lever and the walls of the take-off duct are exposed to a vacuum action by which the fibers which stand out from the yarn are entrapped and act as a braking factor for the backward motion of the yarn into the spinning rotor whereby the reliability of the spinning-in process is impaired.

An object of the present invention is to improve the yarn spinning-in apparatus disclosed in the German DE-OS No. 2,915,788 so as to expediently utilize the subatmospheric pressure air for both the spinning-in process and the withdrawal of impurities from the yarn in the take-off duct.

The afore-mentioned conditions are substantially met by the apparatus according to the invention. In such apparatus, at least one air nozzle opens into the withdrawing duct which during both spinning and spinning-in processes is connected to a subatmospheric pressure source; such nozzle is designed for introducing a fresh end of yarn into the take-off duct by a controlled air outflow in a particular phase of the spinning-in process.

The air nozzle is preferably oriented so as to annihilate the vacuum effect of the withdrawing duct in the contact region of the two ducts.

The yarn can be severed by means of one of known yarn severing devices. From the viewpoint of the reliability of the spinning-in process, it is particularly preferable to use a severing device in the form of a rubbing disc disposed in the contact region of the withdrawing and the take-off duct.

In accordance with one preferred embodiment of the present invention, the air nozzle which is oriented to annihilate the vacuum effect of withdrawing duct in said contact region of the two ducts is associated with another air nozzle for directing the fresh end of yarn from the withdrawing duct to the take-off duct, said two nozzles being arranged on opposite sides of the rubbing disc.

In the first phase of the spinning-in process, which means during the first yarn return, the yarn end is introduced, due to the vacuum effect, from the take-off duct into the withdrawing duct in which it is severed by the rotating rubbing disc.

In the next phase of the spinning-in process, which means during the proceeding yarn return, the vacuum effect of the withdrawing duct is annihilated, due to the action of the air nozzles, in the contact region of the two ducts, whereupon the fresh yarn end is directed to the take-off duct and further on is conveyed to the collecting channel of the spinning rotor.

After the spinning-in process, the operation of the air nozzles is stopped. Due to the vacuum effect of the withdrawing duct, impurities from the yarn are withdrawn from the take-off duct through the withdrawing duct during the normal spinning process.

The main advantageous feature of the present invention is the reliability of the spinning-in process, the operation of the thread breakage feeler not being negatively influenced by the other elements of the invention. The yarn end is fully automatically both severed and withdrawn without any claims being laid upon adjustments or control signals, whereby the mechanism of the spinning-in device is substantially simplified. Before being spun in, the yarn is always given a precise length, and its severed end is automatically withdrawn together with the impurities contained in the yarn so that any additional installations of yarn cleaning vacuum pipelines are unnecessary.

In order that the invention may be better understood and carried into practice, a preferred embodiment thereof will be now described with reference to the accompanying drawings in which:

FIG. 1 shows an open-end spinning unit in accordance with the invention in a partial axial sectional view taken through the spinning rotor, the spinning unit being shown in the normal spinning process; and FIGS. 2–6 show the spinning unit in FIG. 1 in successive individual phases of the spinning-in process.

As can be seen in FIG. 1, a stationary housing 1 of the spinning unit receives a fiber separating device (not shown) to which a fibrous sliver 2 is supplied, and a spinning rotor 3 mounted for rotation in stationary bearings 4. The drive of the spinning rotor 3 and that of the fiber separating device is neither described nor shown in detail since these are mechanisms well-known in the open-end spinning machinery art.

The spinning rotor 3 is housed in a chamber 5 which communicates with a duct 6 for withdrawing working air. The working subatmospheric pressure in the spinning rotor 3 is produced by the ventilating means of the spinning rotor itself and/or by connecting the duct 6 to a vacuum source. A yarn take-off duct 7 in the form of a funnel 8 opens into the spinning rotor 3. A spinning-in funnel 9 is provided at the opposite end of the take-off duct 7.

By means of the fiber separating device, the sliver 2 is opened to form individual or discrete fibers V which, due to a working vacuum effect in the spinning rotor 3, are supplied via a supply duct 10 to a collecting channel 11 of said rotor 3. Yarn 12 produced in the well-known way is withdrawn by take-off rollers 13 and wound to a bobbin in a take-up device (not shown).

The yarn take-off duct 7 carries a thread breakage feeler 14 the contact arm 15 of which bears upon yarn 12 in the region between the outlet end of the take-off duct 7 and the take-off rollers 13.

The feeler 14 is connected by an electric line 16 to a control unit 17 of the spinning-in device (not shown) for remedying thread breakages which arise in the normal spinning process or upon the stopping of the spinning unit. In the spinning process, the spinning-in device is designed for stopping the fiber supply to the spinning rotor 3 and the take-off of severed yarn, so that the yarn end may remain in the take-off duct 7 in the region of the working vacuum effect. Further, the spinning-in device cares for yarn take-off reversal whereby in a first phase the yarn which is determined for being severed is returned, whereupon after the yarn end has been severed, a predetermined yarn length is returned back into the spinning rotor to be pieced on to the fibrous ribbon freshly produced in the collecting channel 11 of the spinning rotor 3 by re-starting the sliver supply device; finally, it cares for restarting the yarn take-off and the normal spinning process. The spinning-in device is constituted, for example, by the device disclosed in the German DE-OS No. 1,510,986. In this case, the control unit 17 which controls the spinning-in device comprises an electromagnetic clutch interposed in the drive of the take-off rollers 13.

In an optional region between the housing 1 and the end of the take-off duct 7, said duct 7 communicates with a withdrawing duct 19 terminating at a collecting chamber 20 which is connected via a screen 21 and a duct 22 to a subatmospheric pressure source (not shown).

The vacuum effect of the withdrawing duct 19 in the contact region 23 of the two ducts 7 and 19 exceeds the subatmospheric pressure produced in the take-off duct 7.

In the contact region 23 of the two ducts 7, 19 there is arranged a known rubbing disc 24 so as to not engage into the take-off duct 7. The surface of said disc 24 is provided with an emery or wire clothing (not shown).

The rubbing disc 24 is driven via gear means from a not shown driving means of the spinning unit either continuously, or preferably, within a predetermined phase of the spinning-in process only, which means in intervals thereof controlled by the control unit 17.

At either side of the rubbing disc 24 there are disposed air nozzles 26 and 27 received in a block 28 which constitutes a connection between the take-off duct 7 and the withdrawing duct 19. Via an air piping 29 and an electromagnetic valve 30, the air nozzles 26, 27 communicate with a through pipeline 31 of superatmospheric pressure air, which pipeline 31 being common for all the the spinning units of the machine. By an electric line 32 the electromagnetic valve 30 is connected to the control unit 17 which controls the operation of the two nozzles 26, 27 during the spinning-in process.

The air nozzle 26 is oriented in such a direction that its air flow indicated by the arrow 33 (FIG. 5) pointing toward the vacuum effect of the withdrawing duct 19, annihilates said effect in the contact region of the two ducts 7, 19. The second air nozzle 27 is oriented so that its air flow indicated by the arrow 34 (FIG. 5) is directed to the bottom part of the take-off duct 7.

In the normal spinning process (FIG. 1), impurities 35 separated on the take-off way from the yarn 12 by rubbing against the walls of the take-off duct 7, at the contact arm 15, or the like, are sucked through the withdrawing duct 19 into the collecting chamber 20 so that they do not, in the usual manner, reach the interior of the spinning rotor.

In case of a breakage of yarn 12 (FIG. 2) caused by a malfunction in the spinning process, the contact arm 15 of the feeler 14 is displaced, due to a decrease of yarn spinning tension in the take-off duct 7, and the feeler 14 releases, via electric line 16, a signal indicated by arrow 36 to the control unit 17 which processes such signal in a known way and transmits a signal to cause the stopping of the supply of sliver 2 to the fiber separating device of the spinning unit, and, via electric line 18, a signal indicated by the arrow 37 to the not shown member of the spinning-in device to reverse the motion of the take-off rollers 13 and, consequently, to cause the backward motion of the end 38 of the broken yarn 12. The signal 37 is to be selected so as to suffice to brake the yarn movement in the take-off duct 7 and to cause its backward motion. On the dying out of signal 37 the backward motion of the take-off rollers 13 stops.

Figure 2:
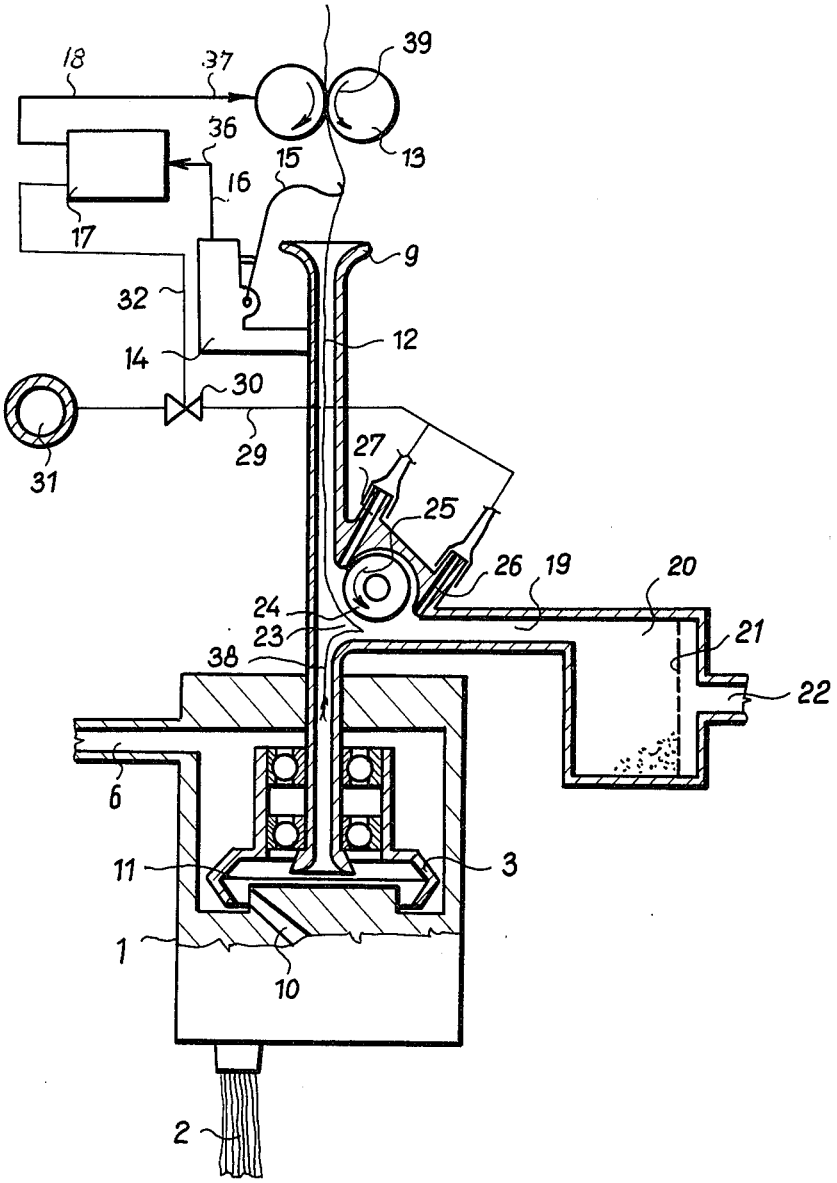

In FIG. 2 the take-off rollers 13 are shown as rotating in the direction of arrow 39, and the sucking of the broken end 38 of yarn 12 into the withdrawing duct 19 has begun. The end 38 begins to wrap about the rubbing disc 24 rotating in the direction of the arrow 25, i.e. in the direction from the take-off duct 7 to the withdrawing duct 19.

Figure 4:
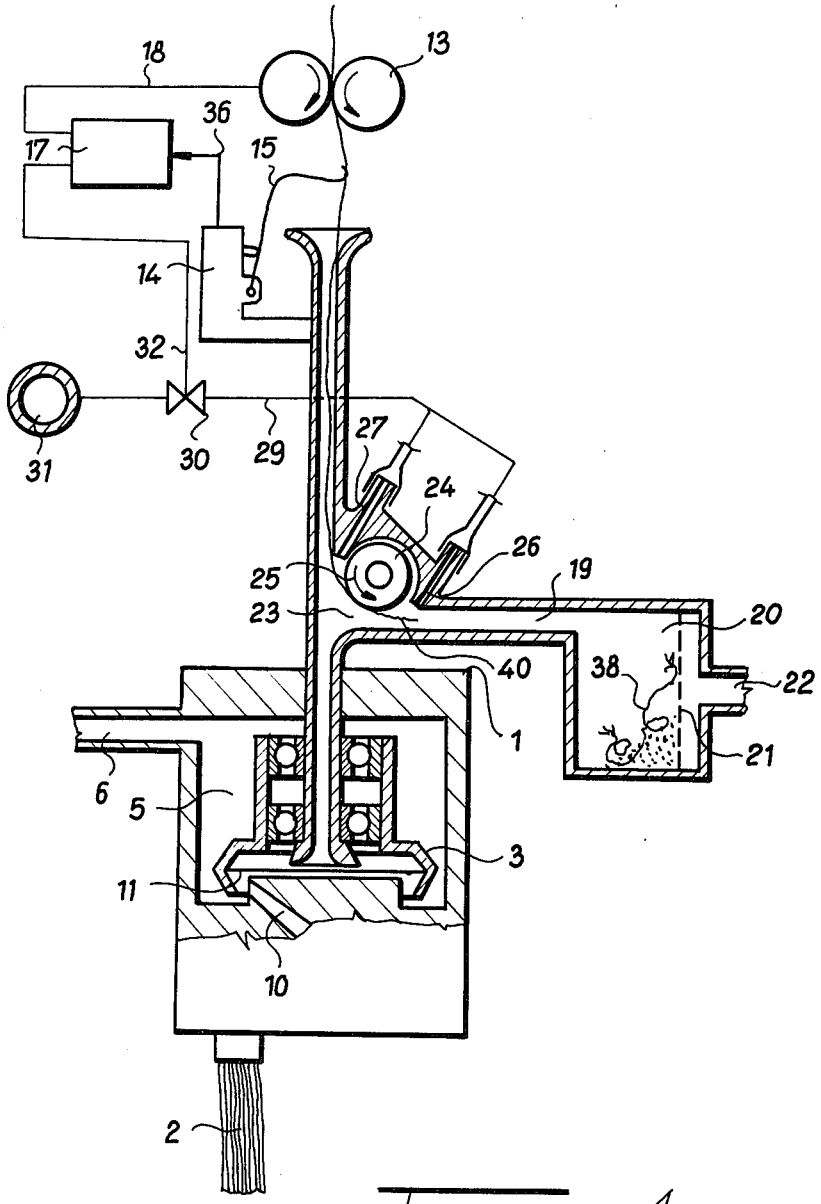
Figure 5:
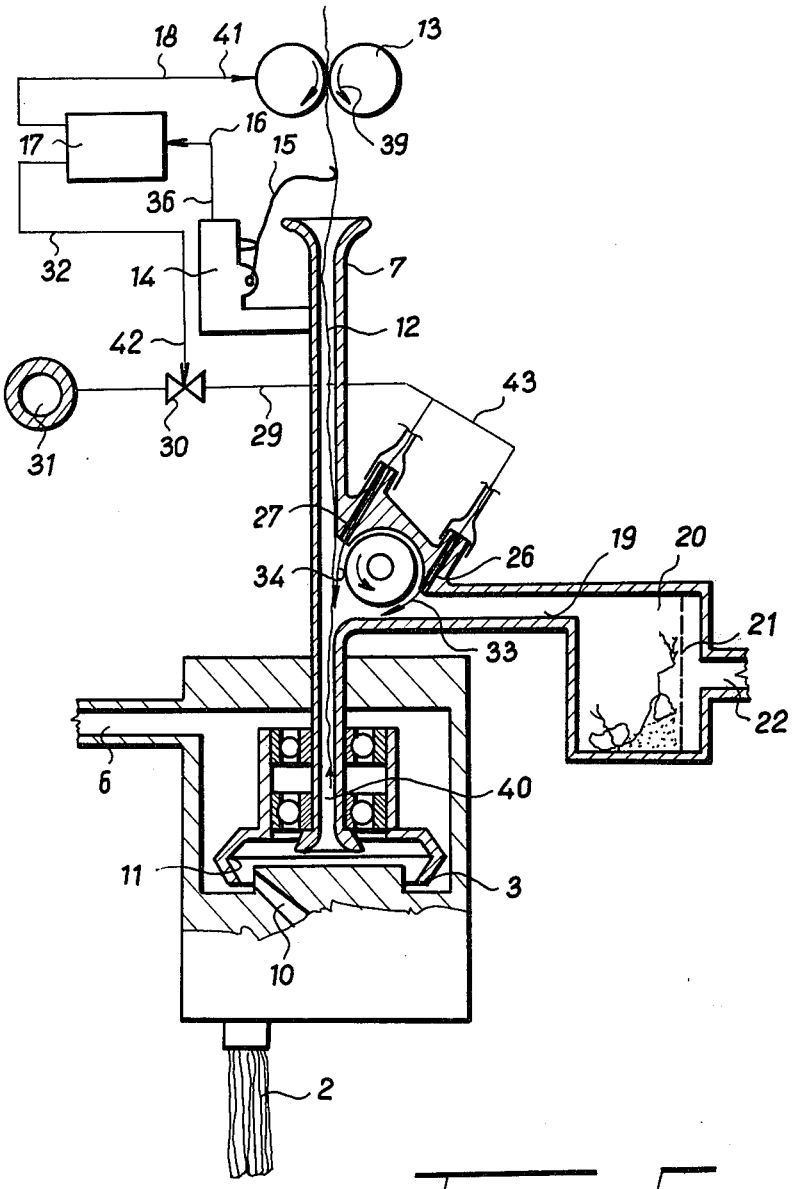
Figure 6:
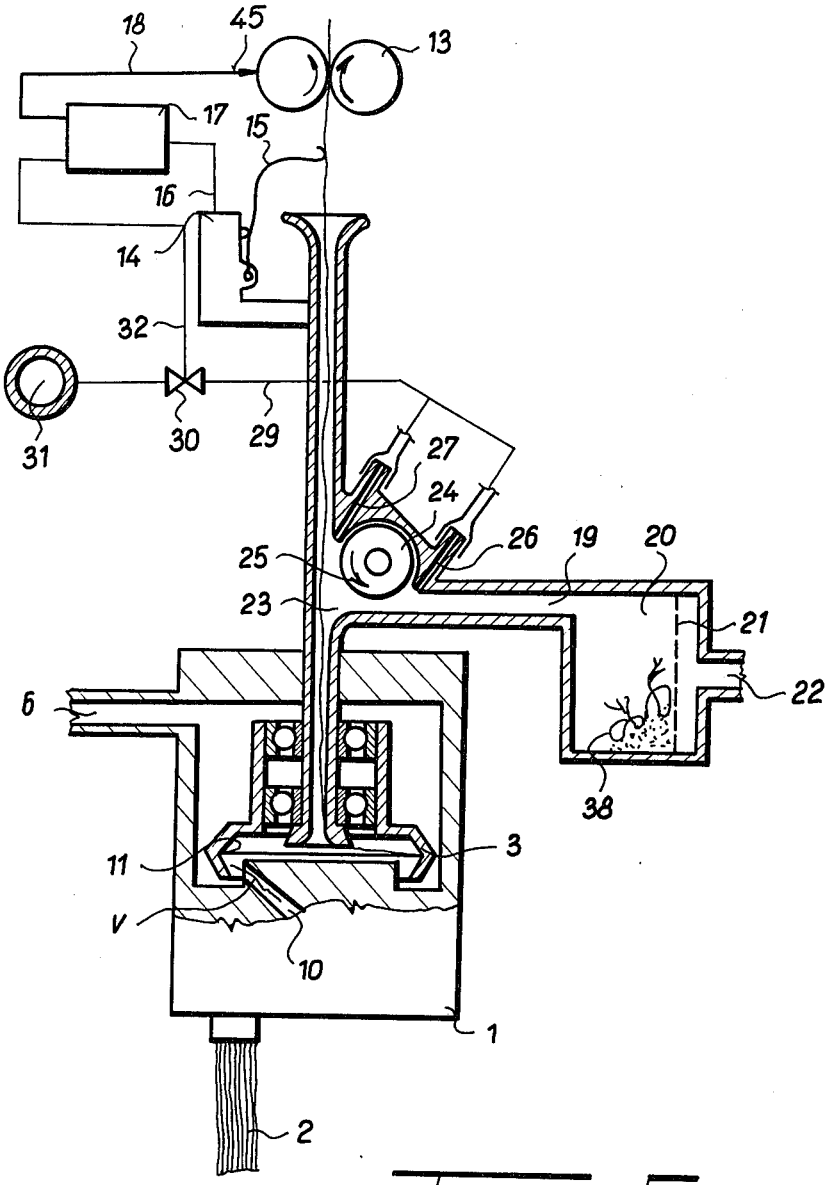

The next phase of the spinning-in process is shown in FIG. 3; by stopping the motion of the take-off rollers 13 the yarn also comes to a standstill and its end 38 is introduced, due to the vacuum effect, into the withdrawing duct 19, the rubbing disc 24 severing the yarn end 38 which is sucked into the collecting chamber 20. The fresh end 40 of yarn 12 remaining in the vacuum effect region of the withdrawing duct 19 is now ready to be spun in, as shown in FIG. 4. The actual spinning-in process is shown in FIGS. 5 and 6. After the spinning rotor 3 has been cleaned either manually or mechanically from impurities and yarn remainders, the control unit 17 releases a signal 41 to cause another reversal of the take-off rollers 13 and thereby to cause the second or final backward motion of the yarn. Simultaneously with the reversal of the take-off rollers 13, the control unit 17 transmits a signal to the supply device which re-establishes the fiber supply to the separating device, and emits a signal 42 to the electromagnetic valve 30 which admits the pressurized air 43 from the through piping 31 into the air nozzles 26, 27. Air flow 33 from the nozzle 26 annihilates the vacuum effect of the withdrawing duct 19 in the contact region 23 of the two ducts 7, 19 while the air flow 34 introduces the fresh yarn end 40 into the bottom part of the take-off duct 7 (FIG. 5).

After the fibrous ribbon in the collecting channel 11 of the spinning rotor 3 has been pieced on to the fresh end 40 of the yarn 12, a functional spinning tension of yarn arises; such tension causes the contact arm 15 to re-occupy its starting position so that the feeler 14 stops the breakage signal 36; this information is electronically processed by the control unit 17 which, by a signal 45, sets the take-off rollers 13 and thereby also the yarn take-off from the spinning rotor 3 into normal operation.

Simultaneously, or immediately after the signal 45, the control unit 17 interrupts the signal to the electromagnetic valve 30, whereupon by re-switching off the air nozzles 26, 27 the vacuum effect of the withdrawing duct 19 in the contact region 23 of the two ducts 7, 19 is re-established and the apparatus is ready for the next spinning-in cycle.

Impurities and separated yarn ends are periodically removed from the collecting chamber 20, either manually or mechanically.

For introducing the fresh end 40 of yarn 12 from the withdrawing duct 19 back into the take-off duct 7, it could be sufficient to use only the operation of the air nozzle 26. After the interruption of the vacuum effect of the withdrawing duct 19 in the contact region 23 of the two ducts 7, 19, the vacuum effect in the take-off duct 7 is sufficient for introducing the fresh yarn end 40 back into said duct 7.

Although the invention is illustrated and described with reference to one preferred embodiment thereof, it is to be expressly understood that it is in no way limited to the disclosure of such preferred embodiment but is capable of numerous modifications within the scope of the appended claims.

We claim:

1. In an apparatus for spinning-in yarns in an open-end rotor spinning unit having a spinning-in device for returning a yarn end through a take-off duct into the spinning rotor, a severing device for shortening the yarn end to a predetermined length, and a withdrawing duct which communicates with the take-off duct and which is designed, on the one hand, for holding the yarn end by the action of a vacuum which, in the contact region of the two ducts, exceeds the working vacuum in the take-off duct, and, on the other hand, for withdrawing the severed yarn end, the improvement comprising a subatmospheric pressure source connected to the withdrawing duct during both spinning and spinning-in processes, and at least one air nozzle which opens into the withdrawing duct, which nozzle is designed for introducing a fresh end of yarn into the take-off duct by a controlled air outflow in a predetermined phase of the spinning-in process.

2. An apparatus as claimed in claim 1, wherein the air nozzle is oriented so as to annihilate the vacuum effect of the withdrawing duct in the contact region of the take-off duct and the withdrawing duct.

3. In an apparatus for spinning-in yarns in an open-end rotor spinning unit having a spinning-in device for returning a yarn end through a take-off duct into the spinning rotor, a severing device for shortening the yarn end to a predetermined length, and a withdrawing duct which communicates with the take-off duct and which is designed, on the one hand, for holding the yarn end by the action of a vacuum which, in the contact region of the two ducts, exceeds the working vacuum in the take-off duct, and, on the other hand, for withdrawing the severed yarn end, the improvement comprising a subatmospheric pressure source connected to the withdrawing duct during both spinning and spinning-in processes, and at least one air nozzle which opens into the withdrawing duct, which nozzle is designed for introducing a fresh end of yarn into the take-off duct by a controlled air outflow in a predetermined phase of the spinning-in process, the severing device being a rubbing disc disposed in the contact region of the withdrawing duct and the take-off duct, and the air nozzle being oriented to annihilate the vacuum effect of the withdrawing duct in said contact region of the said two ducts and being associated with another air nozzle for directing the fresh end of yarn from the withdrawing duct to the take-off duct, said two nozzles being arranged on opposite sides of the rubbing disc.

4. In an apparatus for spinning-in yarns in an open-end rotor spinning unit having a spinning-in device for returning a yarn end through a take-OFF duct into the spinning rotor, a severing device for shortening the yarn end to a predetermined length, and a withdrawing duct which communicates with the take-off duct and which is designed, on the one hand, for holding the yarn end by the action of a vacuum which, in the contact region of the two ducts, exceeds the working vacuum in the take-off duct, and, on the other hand, for withdrawing the severed yarn end, the improvement comprising a subatmospheric pressure source connected to the withdrawing duct during both spinning and spinning-in processes, and at least one air nozzle which opens into the withdrawing duct, which nozzle is designed for introducing a fresh end of yarn into the take-off duct by a controlled air outflow in a predetermined phase of the spinning-in process, the air nozzle being oriented so as to annihilate the vacuum effect of the withdrawing duct in the contact region of the take-off duct and the withdrawing duct, the severing device being a rubbing disc disposed in the contact region of the withdrawing duct and the take-off duct, and the air nozzle which is oriented to annihilate the vacuum effect of the withdrawing duct in said contact region of the two ducts being associated with another air nozzle for directing the fresh end of yarn from the withdrawing duct to the take-off duct, said two nozzles being arranged on opposite sides of the rubbing disc.

* * * * *